US009875688B2

(12) United States Patent
Han

(10) Patent No.: US 9,875,688 B2
(45) Date of Patent: Jan. 23, 2018

(54) AMOLED PIXEL DRIVING CIRCUIT AND METHOD FOR COMPENSATING NONUNIFORM BRIGHTNESS

(71) Applicant: Shenzhen China Star Optoelectronics Technology Co., Ltd., Shenzhen (CN)

(72) Inventor: Baixiang Han, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 266 days.

(21) Appl. No.: 14/655,734

(22) PCT Filed: Apr. 1, 2015

(86) PCT No.: PCT/CN2015/075683
§ 371 (c)(1),
(2) Date: Jun. 26, 2015

(87) PCT Pub. No.: WO2016/119305
PCT Pub. Date: Aug. 4, 2016

(65) Prior Publication Data

US 2016/0307501 A1 Oct. 20, 2016

(30) Foreign Application Priority Data

Jan. 26, 2015 (CN) ..... 2015 1 0039465

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2320/0233* (2013.01); *G09G 2320/045* (2013.01)

(58) Field of Classification Search
CPC ..... G09G 3/3233; G09G 3/32
See application file for complete search history.

(56) References Cited

U.S. PATENT DOCUMENTS

2012/0120042 A1* 5/2012 Tsai ..... G09G 3/3233 345/211
2016/0203759 A1* 7/2016 Han ..... G09G 3/3233 345/212
2017/0069263 A1* 3/2017 Hu ..... G09G 3/32

* cited by examiner

*Primary Examiner* — Sepehr Azari
(74) *Attorney, Agent, or Firm* — Leong C. Lei

(57) ABSTRACT

The present invention provides an AMOLED pixel driving circuit and a pixel driving method. The AMOLED pixel driving circuit utilizes a 6T2C structure, comprising a first, a second, a third, a fourth, a fifth and a sixth thin film transistors (T1, T2, T3, T4, T5, T6), a first, a second capacitors (C1, C2) and an organic light emitting diode (OLED), and the first thin film transistor (T1) is a drive thin film transistor, and the fifth thin film transistor (T5) is a switch thin film transistor; and a first control signal (G1), a second control signal (G2) and a third control signal (G3) are involved, and the three are combined with one another and correspond to a data signal writing stage (1), a whole compensation stage (2), a charging stage (3) and a light emitting stage (4) one after another. The threshold voltage changes of the drive thin film transistor and the organic light emitting diode can be effectively compensated to make the display brightness of the AMOLED more even and to raise the display quality.

12 Claims, 9 Drawing Sheets

AMOLED PIXEL DRIVING CIRCUIT AND METHOD FOR COMPENSATING NONUNIFORM BRIGHTNESS

FIELD OF THE INVENTION

The present invention relates to a display technology field, and more particularly to an AMOLED pixel driving circuit and a pixel driving method.

BACKGROUND OF THE INVENTION

The OLED possesses many outstanding properties of self-illumination, low driving voltage, high luminescence efficiency, fast response, high clarity and contrast, near 180° view angle, wide range of working temperature, applicability of flexible display and large scale full color display. The OLED is considered as the most potential flat panel display technology.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmits voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which is a 2T1C pixel driving circuit employed for AMOLED, comprising a first thin film transistor T10, a second thin film transistor T20 and a capacitor C. The first thin film transistor T10 is a switch thin film transistor, and the second thin film transistor T20 is a drive thin film transistor, and the capacitor C is a storage capacitor. Specifically, a gate of the first thin film transistor T10 is electrically coupled to a scan signal Scan, and a source is electrically coupled to a data signal Data, and a drain is electrically coupled to a gate of the second thin film transistor T20 and one end of the capacitor C; a source of the second thin film transistor T20 is electrically coupled to a power source positive voltage VDD, and a drain is electrically coupled to an anode of an organic light emitting diode D; a cathode of the organic light emitting diode D is electrically coupled to a power source negative voltage VSS; the one end of the capacitor C is electrically coupled to the drain of the first thin film transistor T10, and the other end is electrically coupled to the source of the second thin film transistor T20. As the AMOLED displays, the scan signal Scan controls the first thin film transistor T10 to be activated, and the data signal Data enters the gate of the second thin film transistor T20 and the capacitor C via the first thin film transistor T10. Then, the first thin film transistor T10 is deactivated. With the storage function of the capacitor C, the gate voltage of the second thin film transistor T20 can remain to hold the data signal voltage to make the second thin film transistor T20 to be in the conducted state to drive the current to enter the organic light emitting diode D via the second thin film transistor T20 and to drive the organic light emitting diode D to emit light.

The 2T1C pixel driving circuit traditionally employed for the AMOLED is highly sensitive to the threshold voltage of the thin film transistor, the channel mobility, the trigger voltage and the quantum efficiency of the organic light emitting diode and the transient of the power supply. The threshold voltage of the second thin film transistor T20, i.e. the drive thin film transistor will drift along with the working times. Thus, it results in that the luminescence of the organic light emitting diode D is unstable; furthermore, the drifts of the second thin film transistors T20, i.e. the drive thin film transistors of respective pixels are different, of which the drift values may be increasing or decreasing to cause the nonuniform luminescence and uneven brightness among the respective pixels. The traditional 2T1C pixel driving circuit without compensation can causes 50% nonuniform brightness or even higher.

One method to solve the nonuniform AMOLED display brightness is to add a compensation circuit to each of the pixels. The compensation means that the compensation has to be implemented to the parameters of the drive thin film transistor, such as threshold voltage or mobility to each of the pixels to make the output current irrelevant with these parameters.

SUMMARY OF THE INVENTION

An objective of the present invention is to provide an AMOLED pixel driving circuit, which can effectively compensate the threshold voltage changes of the drive thin film transistor and the organic light emitting diode to make the display brightness of the AMOLED more even and to raise the display quality.

Another objective of the present invention is to provide an AMOLED pixel driving method, which can effectively compensate the threshold voltage changes of the drive thin film transistor and the organic light emitting diode to make the display brightness of the AMOLED more even and to raise the display quality.

For realizing the aforesaid objectives, the present invention provides an AMOLED pixel driving circuit, comprising: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to the second control signal, and a source is electrically coupled to the second node, and a drain is electrically coupled to a third node;

a gate of the second thin film transistor is electrically coupled to a first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

All of the first control signal, the second control signal and the third control signal are provided by an external sequence controller.

The first control signal, the second control signal and the third control signal are combined with one another, and correspond to a data signal writing stage, a whole compensation stage, a charging stage and a light emitting stage one after another;

in the data signal writing stage, the first control signal is low voltage level, and the second control signal is high voltage level, and the third control signal is high voltage level;

in the whole compensation stage, the first control signal is low voltage level, and the second control signal is low voltage level, and the third control signal is high voltage level;

in the charging stage, the first control signal is high voltage level, and the second control signal is low voltage level, and the third control signal is high voltage level;

in the light emitting stage, the first control signal is low voltage level, and the second control signal is high voltage level, and the third control signal is high voltage level.

The scan signal is a pulse signal in the data signal writing stage, and is low voltage level in any of the whole compensation stage, the charging stage and the light emitting stage.

The reference voltage is a constant voltage.

The present invention further provides an AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to the second control signal, and a source is electrically coupled to the second node, and a drain is electrically coupled to a third node;

a gate of the second thin film transistor is electrically coupled to a first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage;

step S2, entering a scan stage;

the first control signal provides low voltage level, and both the second, the fourth thin film transistors are deactivated; the second control signal provides high voltage level; the third control signal provides high voltage level; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides low voltage level, and both the second, the fourth thin film transistors are deactivated; the second control signal provides low voltage level, and the third thin film transistor is deactivated; the third control signal provides high voltage level, and the sixth thin film transistor is activated; the fourth node charges to the organic light emitting diode for the trans-voltage;

step S4, entering a charging stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

$$V_A = V_{Data}$$

wherein $V_A$ is a voltage of the second node, and $V_{Data}$ is the data signal voltage;

the fourth node is charged to:

$$V_S = V_{ref} - V_{th_T1}$$

wherein $V_S$ represents the voltage of the fourth node, i.e. the source of the first thin film transistor, and $V_{ref}$ represents the reference voltage, and $V_{th_T1}$ represents the threshold voltage of the first thin film transistor;

step S5, entering a light emitting stage;

all of the scan signals remain to be low voltage level, and the fifth thin film transistors in all pixels are deactivated; the first control signal provides low voltage level, and both the second, the fourth thin film transistors are activated; the second control signal provides high voltage level, and the third thin film transistor is activated; the third control signal provides high voltage level, and the sixth thin film transistor is activated; the organic light emitting diode emits light, and a current flowing through the organic light emitting diode is irrelevant with the threshold voltage of the first thin film transistor and the threshold voltage of the organic light emitting diode.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

All of the first control signal, the second control signal and the third control signal are provided by an external sequence controller.

The reference voltage is a constant voltage.

The present invention further provides an AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to the second control signal, and a source is electrically coupled to the second node, and a drain is electrically coupled to a third node;

a gate of the second thin film transistor is electrically coupled to a first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage;

step S2, entering a scan stage;

the first control signal provides low voltage level, and both the second, the fourth thin film transistors are deactivated; the second control signal provides high voltage level; the third control signal provides high voltage level; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides low voltage level, and both the second, the fourth thin film transistors are deactivated; the second control signal provides low voltage level, and the third thin film transistor is deactivated; the third control signal provides high voltage level, and the sixth thin film transistor is activated; the fourth node charges to the organic light emitting diode for the trans-voltage;

step S4, entering a charging stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

$$V_A = V_{Data}$$

wherein $V_A$ is a voltage of the second node, and $V_{Data}$ is the data signal voltage;

the fourth node is charged to:

$$V_S = V_{ref} - V_{th_T1}$$

wherein $V_S$ represents the voltage of the fourth node, i.e. the source of the first thin film transistor, and $V_{ref}$ represents the reference voltage, and $V_{th_T1}$ represents the threshold voltage of the first thin film transistor;

step S5, entering a light emitting stage;

all of the scan signals remain to be low voltage level, and the fifth thin film transistors in all pixels are deactivated; the first control signal provides low voltage level, and both the second, the fourth thin film transistors are activated; the second control signal provides high voltage level, and the third thin film transistor is activated; the third control signal provides high voltage level, and the sixth thin film transistor is activated; the organic light emitting diode emits light, and a current flowing through the organic light emitting diode is irrelevant with the threshold voltage of the first thin film transistor and the threshold voltage of the organic light emitting diode;

wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

All of the first control signal, the second control signal and the third control signal are provided by an external sequence controller.

The benefits of the present invention are: the AMOLED pixel driving circuit and the pixel driving method provided by the present invention utilize the 6T2C structure driving circuit to compensate the threshold voltage changes of the drive thin film transistor and the organic light emitting diode in each pixel and the time of the compensation period is adjustable without influencing the light emitting period of the organic light emitting diode, of which the threshold voltage changes of the drive thin film transistor and the organic light emitting diode can be effectively compensated to make the display brightness of the AMOLED more even and to raise the display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
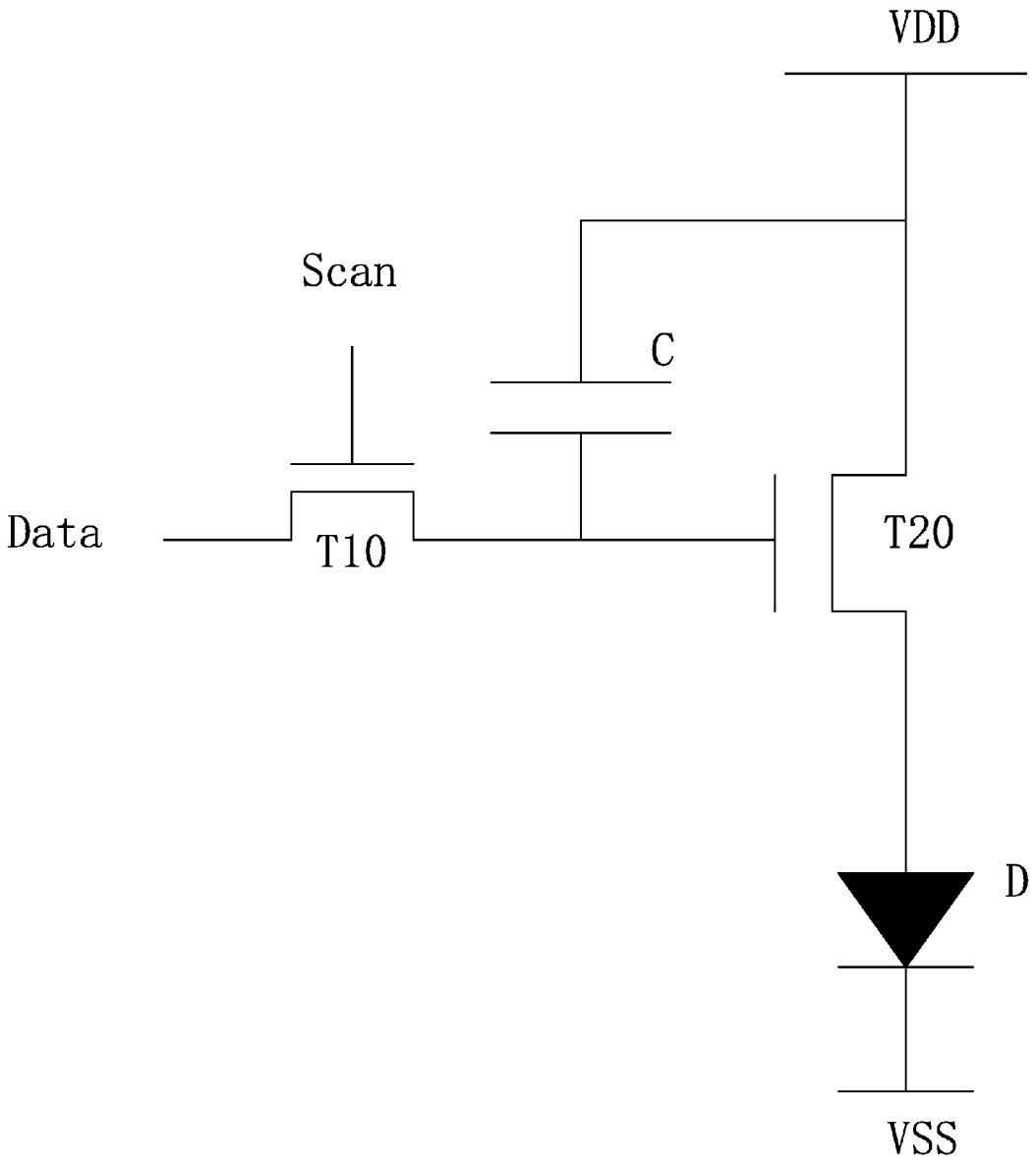
FIG. 1 is a circuit diagram of 2T1C pixel driving circuit employed for AMOLED according to prior art.
Figure 2:
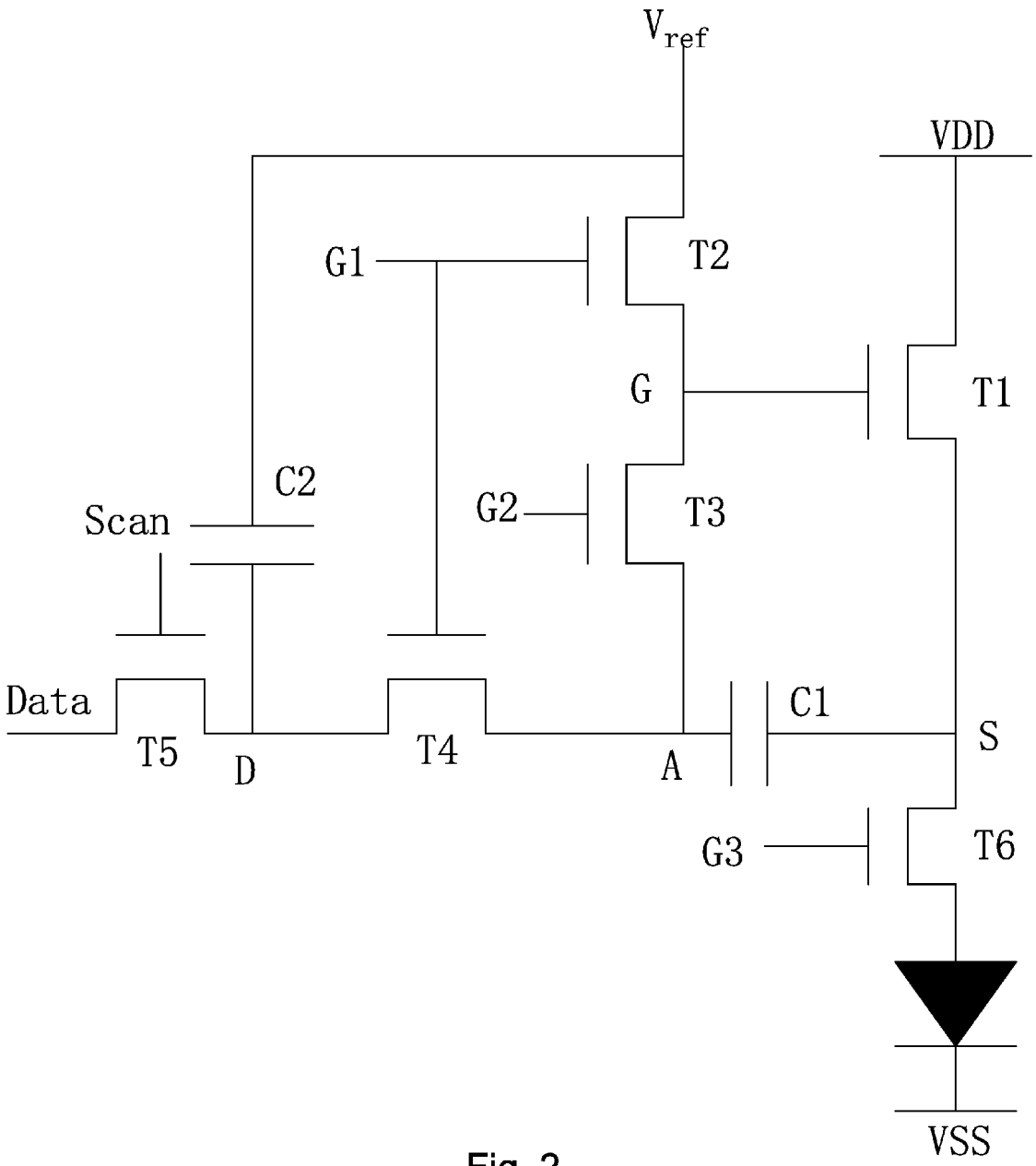
FIG. 2 is a circuit diagram of an AMOLED pixel driving circuit according to present invention.

Please refer to FIG. 2. The present invention provides an AMOLED pixel driving circuit, and the AMOLED pixel driving circuit utilizes a 6T2C structure, and comprises: a first thin film transistor T1, a second thin film transistor T2, a third thin film transistor T3, a fourth thin film transistor T4, a fifth thin film transistor T5, a sixth thin film transistor T6, a first capacitor C1, a second capacitor C2 and an organic light emitting diode OLED.

A gate of the fifth thin film transistor T5 is electrically coupled to a scan signal Scan, and a source is electrically coupled to a data signal Data, and a drain is electrically coupled to a first node D; a gate of the fourth thin film transistor T4 is electrically coupled to a first control signal G1, and a source is electrically coupled to the first node D, and a drain is electrically coupled to a second node A; a gate of the third thin film transistor T3 is electrically coupled to the second control signal G2, and a source is electrically coupled to the second node A, and a drain is electrically coupled to a third node G; a gate of the second thin film transistor T2 is electrically coupled to a first control signal G1, and a source is electrically coupled to the third node G, and a drain is electrically coupled to one end of the second capacitor C2 and a reference voltage $V_{ref}$; a gate of the first thin film transistor T1 is electrically coupled to the third node G, and the drain is electrically coupled to a power source positive voltage VDD, and a source is electrically coupled to a fourth node S; a gate of the sixth thin film transistor T6 is electrically coupled to a third control signal G3, and a source is electrically coupled to the fourth node S, and a drain is electrically coupled to an anode of the organic light emitting diode OLED; one end of the first capacitor C1 is electrically coupled to the second node A, and the other end is electrically coupled to the fourth node S; the one end of the second capacitor C2 is electrically coupled to the drain of the second thin film transistor T2 and the reference voltage $V_{ref}$, and the other end is electrically coupled to the first node D; the anode of the organic light emitting diode OLED is electrically coupled to the drain of the sixth thin film transistor T6, and a cathode is electrically coupled to a power source negative voltage VSS.

The first control signal G1 is employed to control the activations and deactivations of the second, the fourth thin film transistors T2, T4; the second control signal G2 is employed to control the activation and deactivation of the third thin film transistors T3; the third control signal G3 is employed to control the activation and deactivation of the sixth thin film transistors T6; the scan signal Scan is employed to control the activation and deactivation of the fifth thin film transistors T5 to realize the scan line by line; the data signal Data is employed to control the brightness of the organic light emitting diode OLED. The reference voltage $V_{ref}$ is a constant voltage. The first thin film transistor T1 is a drive thin film transistor, and the fifth thin film transistor T5 is a switch thin film transistor.

Specifically, all of the first thin film transistor T1, the second thin film transistor T2, the third thin film transistor T3, the fourth thin film transistor T4, the fifth thin film transistor T5 and the sixth thin film transistor T6 are Low Temperature Poly-silicon thin film transistors, oxide semiconductor thin film transistors or amorphous silicon thin film transistors. All of the first control signal G1, the second control signal G2 and the third control signal G3 are provided by an external sequence controller.

Figure 3:
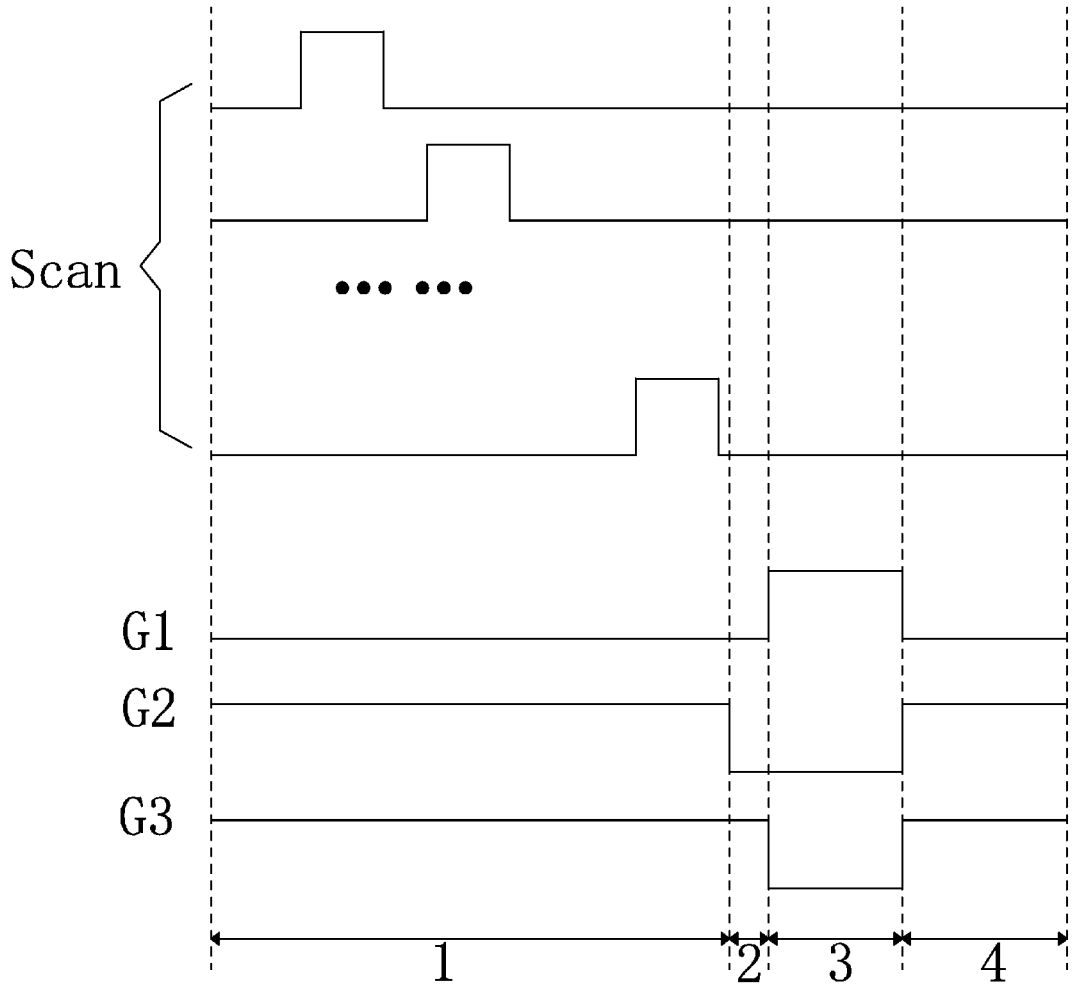
FIG. 3 is a sequence diagram of an AMOLED pixel driving circuit according to present invention.

Furthermore, referring to FIG. 3, the first control signal G1, the second control signal G2 and the third control signal G3 are combined with one another and correspond to a data signal writing stage 1, a whole compensation stage 2, a charging stage 3 and a light emitting stage 4 one after another. In the data signal writing stage 1, the first control signal G1 is low voltage level, and the second control signal G2 is high voltage level, and the third control signal G3 is high voltage level; in the whole compensation stage 2, the first control signal G1 is low voltage level, and the second control signal G2 is low voltage level, and the third control signal G3 is high voltage level; in the charging stage 3, the first control signal G1 is high voltage level, and the second control signal G2 is low voltage level, and the third control signal G3 is low voltage level; in the light emitting stage 4, the first control signal G1 is low voltage level, and the second control signal G2 is high voltage level, and the third control signal G3 is high voltage level. The scan signal Scan is a pulse signal in the data signal writing stage 1, and is low voltage level in any of the whole compensation stage 2, the charging stage 3 and the light emitting stage 4.

In the data signal writing stage 1, a line by line scan is implemented with the scan signal Scan, and the data signal Data is written into the first node D line by line and stored in the second capacitor C2; in the whole compensation stage 2, the fourth node S charges to the organic light emitting diode OLED for the trans-voltage; in the charging stage 3, the third node G is written with the reference voltage $V_{ref}$, and the second node A is written with the data signal Data, and the fourth node S is charged; in the light emitting stage 4, the organic light emitting diode OLED emits light, and a current flowing through the organic light emitting diode OLED is irrelevant with the threshold voltage of the first thin film transistor T1 and the threshold voltage of the organic light emitting diode OLED.

The AMOLED pixel driving circuit can effectively compensate the threshold voltage changes of the first thin film transistor T1, i.e. the drive thin film transistor and the organic light emitting diode OLED to make the display brightness of the AMOLED more even and to raise the display quality.

Figure 4:
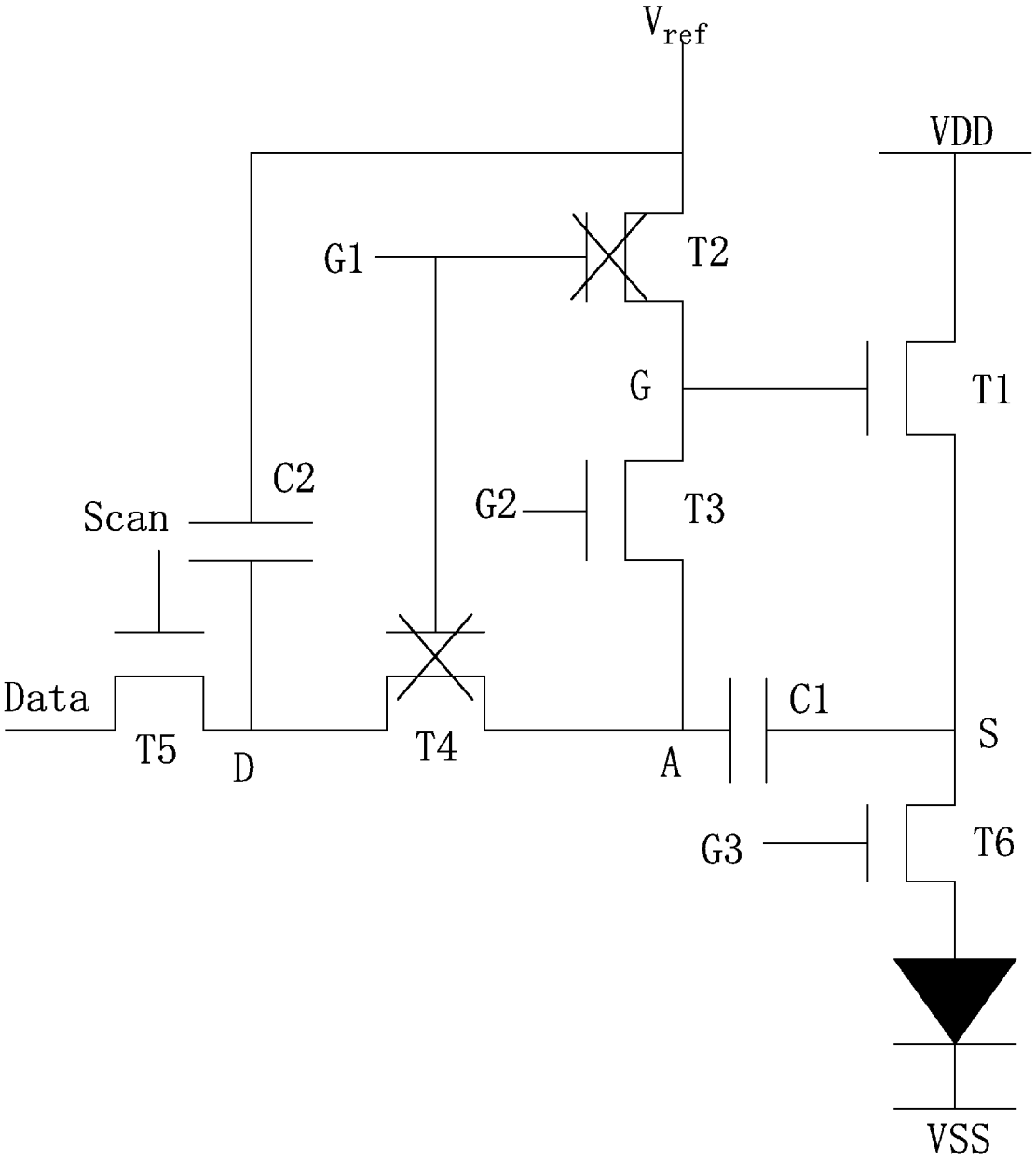
FIG. 4 is a diagram of the step S2 of a AMOLED pixel driving method according to the present invention.

Please refer from FIG. 4 to FIG. 7 in conjunction with FIG. 2 and FIG. 3. On the basis of the aforesaid AMOLED pixel driving circuit, the present invention further provides an AMOLED pixel driving method, comprising steps of:

step S1, providing an AMOLED pixel driving circuit utilizing the 6T2C structure as shown in the aforesaid FIG. 2, and the description of the circuit is not repeated here.

step S2, referring to FIG. 3 and FIG. 4, entering a scan stage 1.

Figure 5:
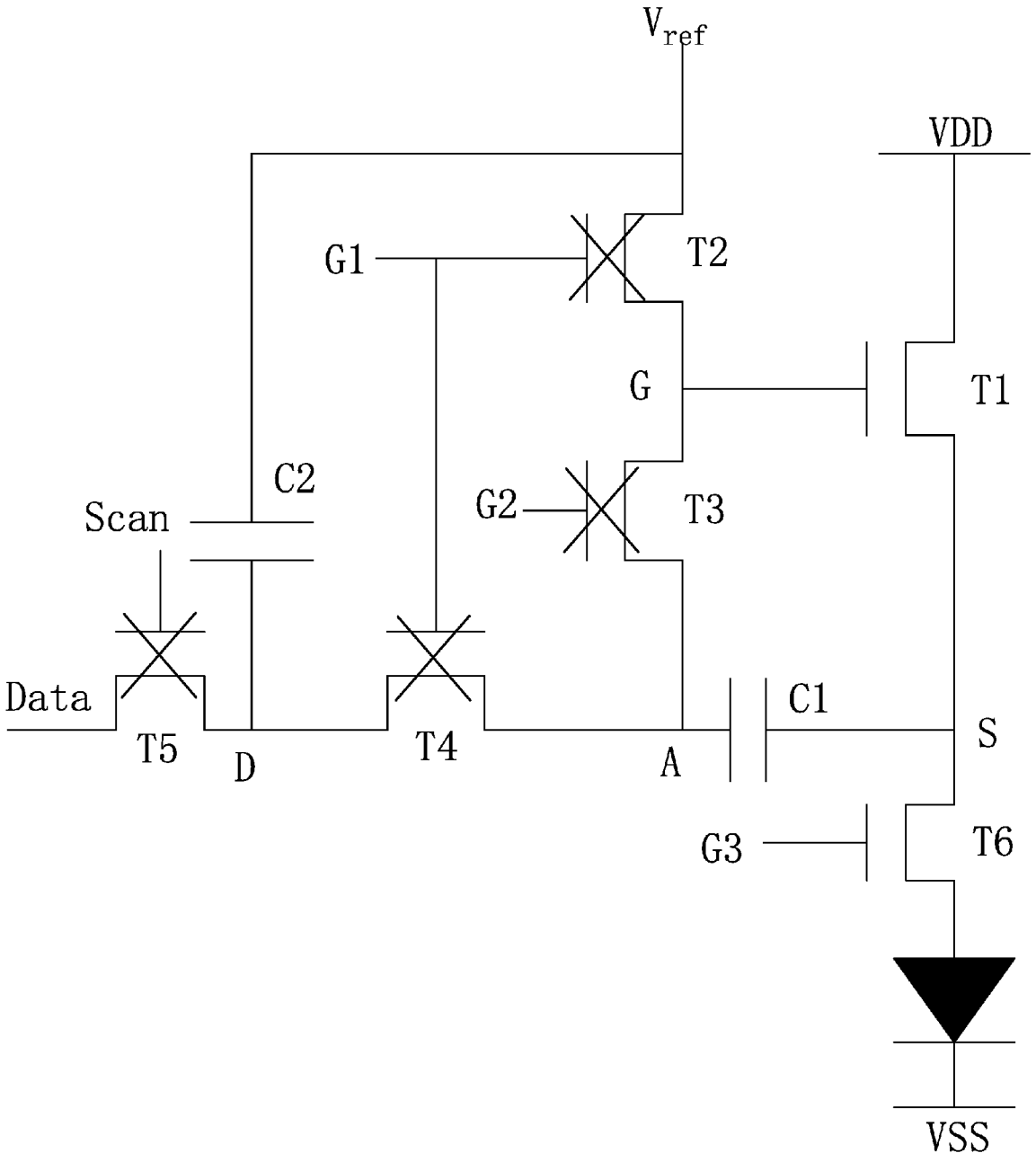
FIG. 5 is a diagram of the step S3 of a AMOLED pixel driving method according to the present invention.

The first control signal G1 provides low voltage level, and both the second, the fourth thin film transistors T2, T4 are deactivated; the second control signal G2 provides high voltage level, and the third thin film transistor T3 is activated; the third control signal G3 provides high voltage level, and the sixth thin film transistor T6 is activated; the scan signal Scan is a pulse signal and a line by line scan is implemented, and the fifth thin film transistors T5 are activated line by line, and the data signal Data is transmitted from the source of the fifth thin film transistor T5 to the drain of thereof to be written into the first node D line by line. Then, with the first control signal G1 to provide low voltage level, the fourth thin film transistor T4 is deactivated. The data signal Data stops being transmitted forward and temporarily stored in the second capacitor C2.

step S3, referring to FIG. 3 and FIG. 5, entering a whole compensation stage 2.

Figure 6:
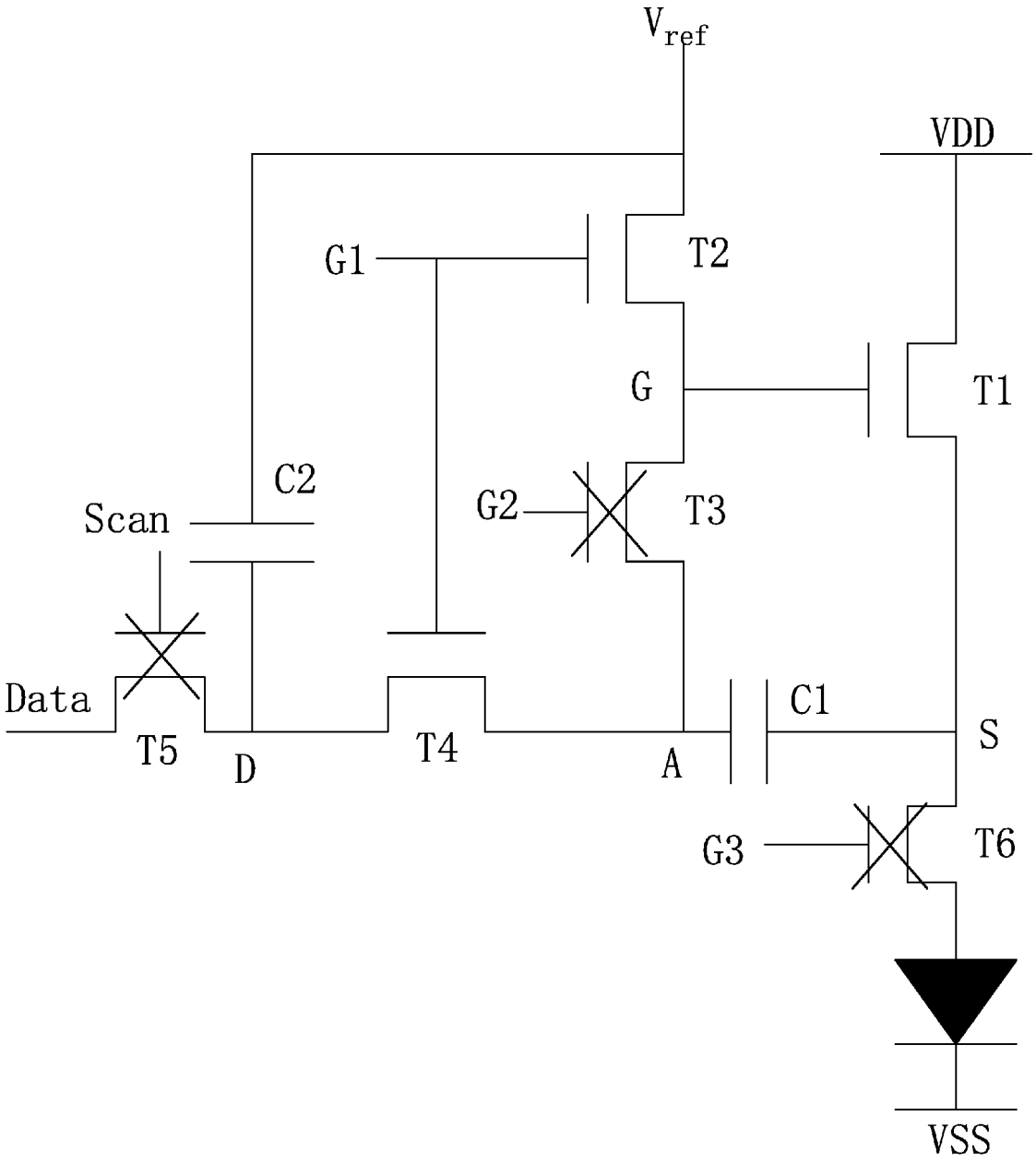
FIG. 6 is a diagram of the step S4 of a AMOLED pixel driving method according to the present invention.

All of the scan signals Scan are low voltage level, and the fifth thin film transistors T5 in all pixels are deactivated; the first control signal G1 provides low voltage level, and both the second, the fourth thin film transistors T2, T4 are deactivated; the second control signal G2 provides low voltage level, and the third thin film transistor T3 is deactivated; the third control signal G3 provides high voltage level, and the sixth thin film transistor T6 is activated; the fourth node S charges to the organic light emitting diode OLED for the trans-voltage.

step S4, referring to FIG. 3 and FIG. 6, entering a charging stage 3.

Figure 7:
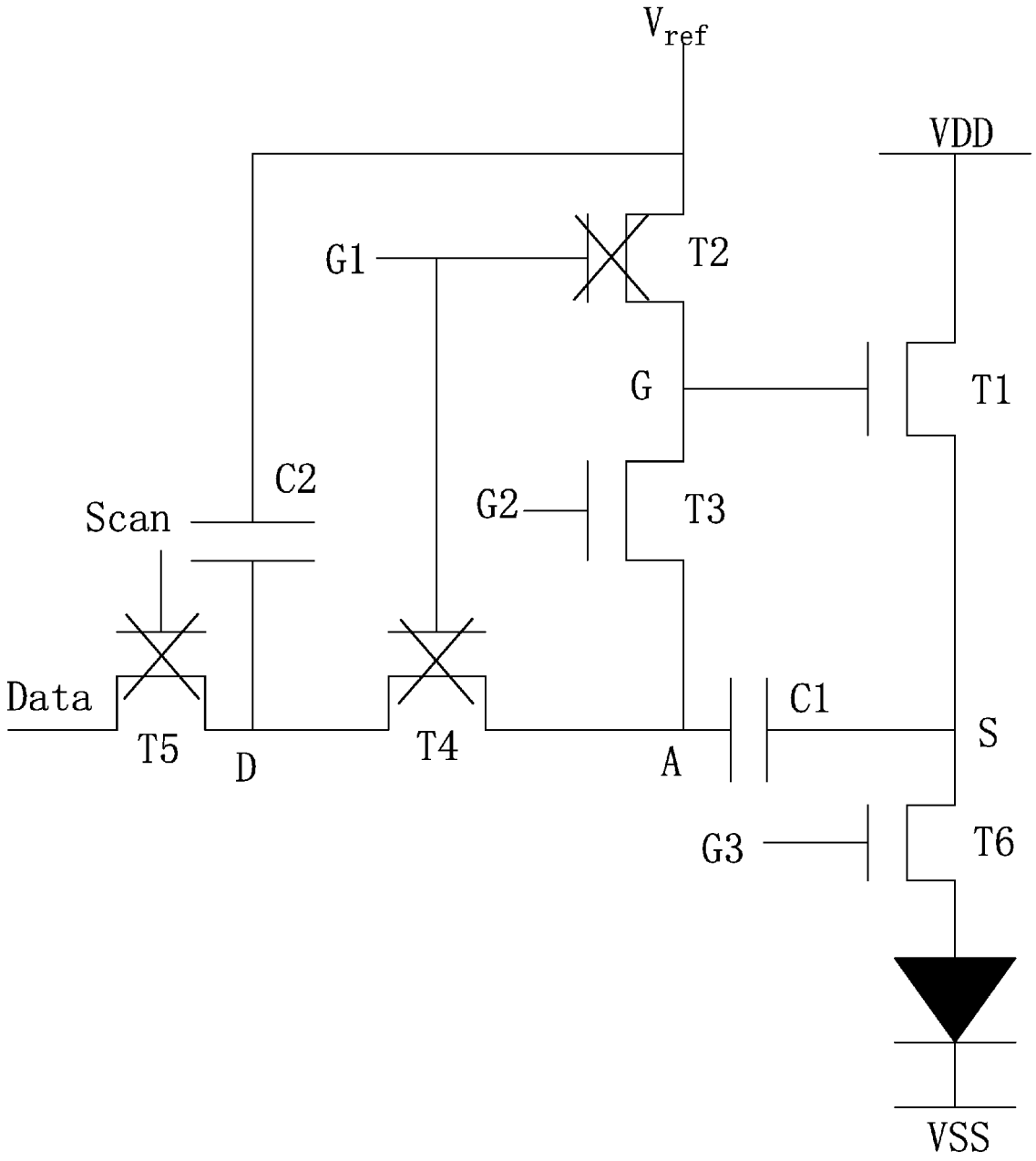
FIG. 7 is a diagram of the step S5 of a AMOLED pixel driving method according to the present invention.

All of the scan signals Scan remain to be low voltage level, and the fifth thin film transistors T5 in all pixels are deactivated; the first control signal G1 provides low voltage level, and both the second, the fourth thin film transistors T2, T4 are activated; the second control signal G2 provides low voltage level, and the third thin film transistor T3 is deactivated; the third control signal G3 provides low voltage level, and the sixth thin film transistor T6 is deactivated; the third node G is written with the reference voltage $V_{ref}$, and the second node A is written with the data signal Data, i.e.:

$$V_A = V_{Data} \tag{1}$$

wherein $V_A$ is a voltage of the second node A, and $V_{Data}$ is the voltage of the data signal Data;

the fourth node S is charged to:

$$V_S = V_{ref} - V_{th_T1} \tag{2}$$

wherein $V_S$ represents the voltage of the fourth node S, i.e. the source of the first thin film transistor T1, and $V_{ref}$ represents the reference voltage, and $V_{th_T1}$ represents the threshold voltage of the first thin film transistor T1.

step S5, referring to FIG. 3 and FIG. 7, entering a light emitting stage 4.

All of the scan signals Scan remain to be low voltage level, and the fifth thin film transistors T5 in all pixels are deactivated; the first control signal G1 provides low voltage level, and both the second, the fourth thin film transistors T2, T4 are activated; the second control signal G2 provides high voltage level, and the third thin film transistor T3 is activated; the third control signal G3 provides high voltage level, and the sixth thin film transistor T6 is activated.

Because the third thin film transistor T3 is activated, and both the second, the fourth thin film transistors T2, T4 are deactivated to make the voltage of the third node G, i.e. the gate voltage of the first thin film transistor T1 be equal to the voltage of the second node A, and the voltage $V_{gs}$ between the gate and the source of the first thin film transistor T1 is calculated below:

$$V_{gs} = VA - V_S \tag{3}$$

the aforesaid equation (1), equation (2) are substituted into equation (3) to derive:

$$V_{gs} = V_{Data} - (V_{ref} - V_{th_T1}) = V_{Data} - V_{ref} + V_{th_T1} \tag{4}$$

The organic light emitting diode OLED emits light.

As known, the formula of calculating the current flowing through the organic light emitting diode OLED is:

$$I = 1/2Cox(\mu W/L)(V_{gs} - V_{th})^2 \tag{5}$$

wherein I is the current flowing through the organic light emitting diode OLED, and μ is the carrier mobility of drive thin film transistor, and W and L respectively are the width and the length of the channel of the drive thin film transistor, and $V_{gs}$ is the voltage between the gate and the source of the drive thin film transistor, and $V_{th}$ is the threshold voltage of the drive thin film transistor.

In the present invention, the drive thin film transistor is the first thin film transistor T1, and the aforesaid equation (4) is substituted into equation (5) to derive:

$$\begin{aligned} I &= 1/2Cox(\mu W/L)(V_{Data} - V_{ref} + V_{th_T1} - V_{th_T1})^2 \\ &= 1/2Cox(\mu W/L)(V_{Data} - V_{ref})^2 \end{aligned}$$

Thus it can be seen, the current I flowing through the organic light emitting diode OLED is irrelevant with the threshold voltage $V_{th_T1}$ of the first thin film transistor T1, the threshold voltage $V_{th_OLED}$ of the organic light emitting diode OLED and the power source negative voltage VSS to realize the compensation function. The threshold voltage changes of the drive thin film transistor, i.e. the first thin film transistor T1 and the organic light emitting diode OLED can be effectively compensated to make the display brightness of the AMOLED more even and to raise the display quality.

Furthermore, the AMOLED pixel driving method possesses the properties below: merely one set of GOA signal is required; the period of the whole compensation stage 2 in the step S3 is adjustable; the light emitting period of the organic light emitting diode is not influenced; the threshold voltage $V_{th_T1}$ of the first thin film transistor T1, the threshold voltage $V_{th_OLED}$ of the organic light emitting diode OLED and the power source negative voltage VSS can be compensated.

Figure 8:
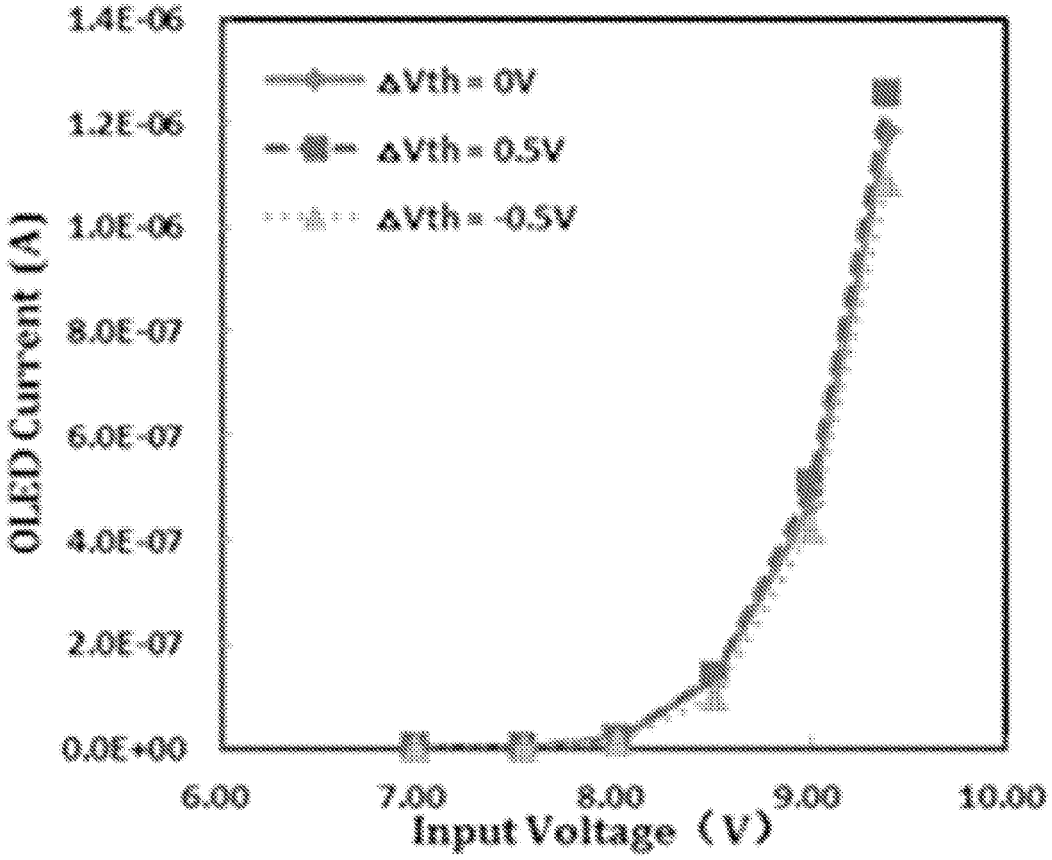
FIG. 8 is a simulation diagram of the corresponding current flowing through the OLED as the threshold voltage of the drive thin film transistor in the present invention drifts.

Please refer to FIG. 8. As the threshold voltage of the drive thin film transistor, i.e. the first thin film transistor T1 respectively drifts 0V, +0.5V, −0.5V, the maximum change of the current flowing through the organic light emitting diode OLED will not exceed 20%, which effectively ensures the light emitting stability of the organic light emitting diode OLED to make the brightness of the AMOLED more even.

Figure 9:
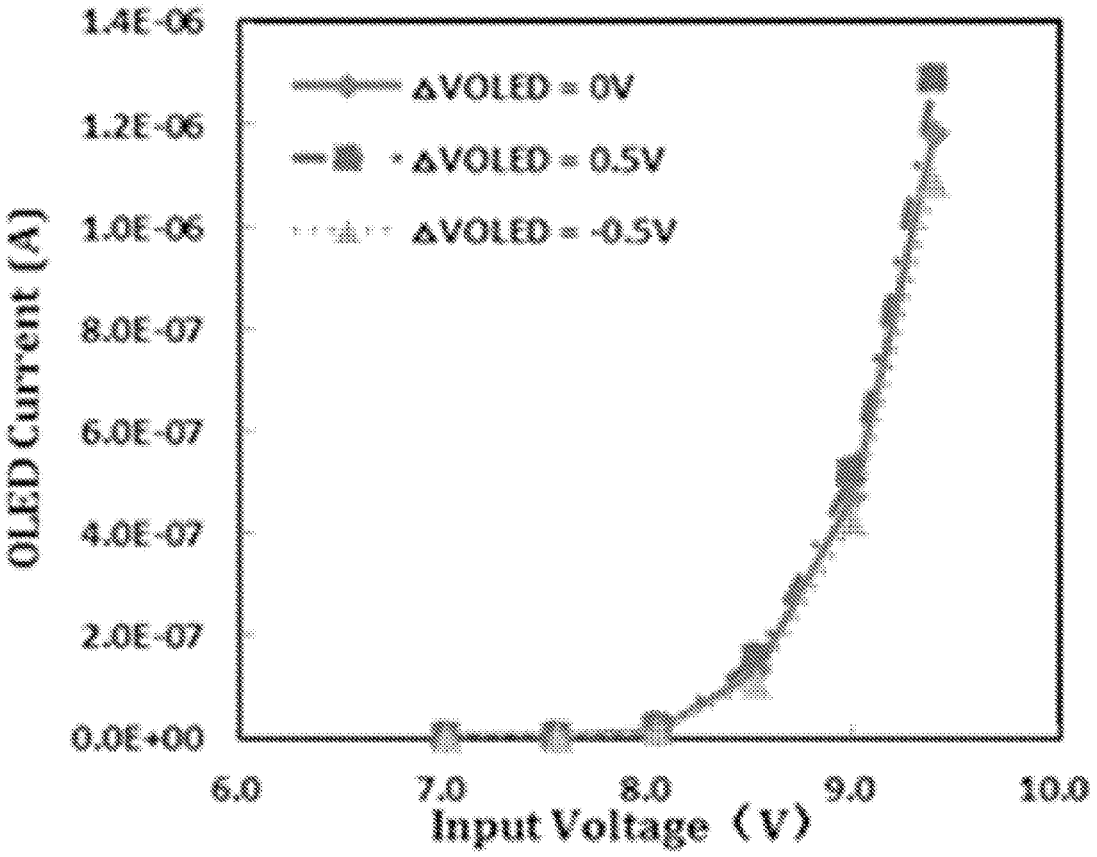
FIG. 9 is a simulation diagram of the corresponding current flowing through the OLED as the threshold voltage of the OLED in the present invention drifts.

Please refer to FIG. 9. As the threshold voltage of the organic light emitting diode OLED respectively drifts 0V, +0.5V, −0.5V, the maximum change of the current flowing through the organic light emitting diode OLED will not exceed 20%, which effectively ensures the light emitting stability of the organic light emitting diode OLED to make the brightness of the AMOLED more even.

In conclusion, the AMOLED pixel driving circuit and the pixel driving method provided by the present invention utilize the 6T2C structure driving circuit to compensate the threshold voltage changes of the drive thin film transistor and the organic light emitting diode in each pixel and the time of the compensation period is adjustable without influencing the light emitting period of the organic light emitting diode, of which the threshold voltage changes of the drive thin film transistor and the organic light emitting diode can be effectively compensated to make the display brightness of the AMOLED more even and to raise the display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving circuit, comprising:

a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to a second control signal, and a source is electrically coupled to the second node, and a drain is electrically coupled to a third node;

a gate of the second thin film transistor is electrically coupled to the first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage.

2. The AMOLED pixel driving circuit according to claim 1, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

3. The AMOLED pixel driving circuit according to claim 1, wherein all of the first control signal, the second control signal and the third control signal are provided by an external sequence controller.

4. The AMOLED pixel driving circuit according to claim 1, wherein the first control signal, the second control signal and the third control signal are combined with one another, and correspond to a data signal writing stage, a whole compensation stage, a charging stage and a light emitting stage one after another;

in the data signal writing stage, the first control signal is low voltage level, and the second control signal is high voltage level, and the third control signal is high voltage level;

in the whole compensation stage, the first control signal is low voltage level, and the second control signal is low voltage level, and the third control signal is high voltage level;

in the charging stage, the first control signal is high voltage level, and the second control signal is low voltage level, and the third control signal is high voltage level;

in the light emitting stage, the first control signal is low voltage level, and the second control signal is high voltage level, and the third control signal is high voltage level.

5. The AMOLED pixel driving circuit according to claim 4, wherein the scan signal is a pulse signal in the data signal writing stage, and is low voltage level in any of the whole compensation stage, the charging stage and the light emitting stage.

6. The AMOLED pixel driving circuit according to claim 1, wherein the reference voltage is a constant voltage.

7. An AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to a second control signal, and a source is electrically coupled to the second node, and a drain is electrically coupled to a third node;

a gate of the second thin film transistor is electrically coupled to the first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage;

step S2, entering a scan stage;

the first control signal provides low voltage level, and both the second, the fourth thin film transistors are deactivated; the second control signal provides high voltage level; the third control signal provides high voltage level; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides low voltage level, and both the second, the fourth thin film transistors are deactivated; the second control signal provides low voltage level, and the third thin film transistor is deactivated; the third control signal provides high voltage level, and the sixth thin film transistor is activated; the fourth node charges to the organic light emitting diode for a trans-voltage;

step S4, entering a charging stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

$$V_A = V_{Data}$$

wherein $V_A$ is a voltage of the second node, and $V_{Data}$ is the data signal voltage;

the fourth node is charged to:

$$V_S = V_{ref} - V_{th_T1}$$

wherein $V_S$ represents the voltage of the fourth node, i.e. the source of the first thin film transistor, and $V_{ref}$ represents the reference voltage, and $V_{th_T1}$ represents the threshold voltage of the first thin film transistor;

step S5, entering a light emitting stage;

all of the scan signals remain to be low voltage level, and the fifth thin film transistors in all pixels are deactivated; the first control signal provides low voltage level, and both the second, the fourth thin film transistors are activated; the second control signal provides high voltage level, and the third thin film transistor is activated; the third control signal provides high voltage level, and the sixth thin film transistor is activated; the organic light emitting diode emits light, and a current flowing through the organic light emitting diode is irrelevant with the threshold voltage of the first thin film transistor and the threshold voltage of the organic light emitting diode.

8. The AMOLED pixel driving method according to claim 7, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

9. The AMOLED pixel driving method according to claim 7, wherein all of the first control signal, the second control signal and the third control signal are provided by an external sequence controller.

10. The AMOLED pixel driving method according to claim 7, wherein the reference voltage is a constant voltage.

11. An AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the third thin film transistor is electrically coupled to a second control signal, and a source is electrically coupled to the second node, and a drain is electrically coupled to a third node;

a gate of the second thin film transistor is electrically coupled to the first control signal, and a source is electrically coupled to the third node, and a drain is electrically coupled to one end of the second capacitor and a reference voltage;

a gate of the first thin film transistor is electrically coupled to the third node, and the drain is electrically coupled to a power source positive voltage, and a source is electrically coupled to a fourth node;

a gate of the sixth thin film transistor is electrically coupled to a third control signal, and a source is electrically coupled to the fourth node, and a drain is electrically coupled to an anode of the organic light emitting diode;

one end of the first capacitor is electrically coupled to the second node, and the other end is electrically coupled to the fourth node;

the one end of the second capacitor is electrically coupled to the drain of the second thin film transistor and the reference voltage, and the other end is electrically coupled to the first node;

the anode of the organic light emitting diode is electrically coupled to the drain of the sixth thin film transistor, and a cathode is electrically coupled to a power source negative voltage;

step S2, entering a scan stage;

the first control signal provides low voltage level, and both the second, the fourth thin film transistors are deactivated; the second control signal provides high voltage level; the third control signal provides high voltage level; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides low voltage level, and both the second, the fourth thin film transistors are deactivated; the second control signal provides low voltage level, and the third thin film transistor is deactivated; the third control signal provides high voltage level, and the sixth thin film transistor is activated; the fourth node charges to the organic light emitting diode for a trans-voltage;

step S4, entering a charging stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

$$V_A = V_{Data}$$

wherein $V_A$ is a voltage of the second node, and $V_{Data}$ is the data signal voltage;

the fourth node is charged to:

$$VS = V_{ref} - V_{th_T1}$$

wherein $V_S$ represents the voltage of the fourth node, i.e. the source of the first thin film transistor, and $V_{ref}$ represents the reference voltage, and $V_{th_T1}$ represents the threshold voltage of the first thin film transistor;

step S5, entering a light emitting stage;

all of the scan signals remain to be low voltage level, and the fifth thin film transistors in all pixels are deactivated; the first control signal provides low voltage level, and both the second, the fourth thin film transistors are activated; the second control signal provides high voltage level, and the third thin film transistor is activated; the third control signal provides high voltage level, and the sixth thin film transistor is activated; the organic light emitting diode emits light, and a current flowing through the organic light emitting diode is irrelevant with the threshold voltage of the first thin film transistor and the threshold voltage of the organic light emitting diode;

wherein all of the first thin film transistor, the second thin film transistor, the third thin film transistor, the fourth thin film transistor, the fifth thin film transistor and the sixth thin film transistor are Low Temperature Polysilicon thin film transistors, oxide semiconductor thin film transistors or amorphous silicon thin film transistors;

all of the first control signal, the second control signal and the third control signal are provided by an external sequence controller.

12. The AMOLED pixel driving method according to claim 11, wherein the reference voltage is a constant voltage.

* * * * *